US012312871B2

(12) United States Patent
Saraya

(10) Patent No.: US 12,312,871 B2
(45) Date of Patent: May 27, 2025

(54) INTERVENTIONLESS METHODS AND SYSTEMS FOR TESTING A LINER TOP

(71) Applicant: Vertice Oil Tools, Stafford, TX (US)

(72) Inventor: Mohamed Ibrahim Saraya, Sugarland, TX (US)

(73) Assignee: VERTICE OIL TOOLS, INC., Missouri City, TX (US)

( * ) Notice: Subject to any disclaimer, the term of this patent is extended or adjusted under 35 U.S.C. 154(b) by 151 days.

(21) Appl. No.: 18/230,811

(22) Filed: Aug. 7, 2023

(65) Prior Publication Data

US 2024/0068301 A1 Feb. 29, 2024

Related U.S. Application Data

(60) Provisional application No. 63/400,464, filed on Aug. 24, 2022.

(51) Int. Cl.

| | |
|---|---|
| ***E21B 17/06*** | (2006.01) |
| ***E21B 17/02*** | (2006.01) |
| ***E21B 33/12*** | (2006.01) |
| ***E21B 33/14*** | (2006.01) |
| ***E21B 43/26*** | (2006.01) |

(52) U.S. Cl.

CPC ..... *E21B 17/021* (2013.01); *E21B 17/06* (2013.01); *E21B 33/12* (2013.01); *E21B 33/14* (2013.01); *E21B 43/26* (2013.01)

(58) Field of Classification Search

None

See application file for complete search history.

(56) References Cited

U.S. PATENT DOCUMENTS

| | | | | |
|---|---|---|---|---|
| 5,477,925 | A * | 12/1995 | Trahan | E21B 41/0042 166/50 |
| 5,743,335 | A * | 4/1998 | Bussear | E21B 33/16 166/242.7 |
| 2012/0222861 | A1* | 9/2012 | Eriksen | E21B 33/128 166/290 |
| 2015/0252650 | A1* | 9/2015 | Gaspard | E21B 17/00 166/153 |
| 2018/0252053 | A1* | 9/2018 | Rico | E21B 43/10 |
| 2018/0320487 | A1* | 11/2018 | Themig | E21B 43/26 |
| 2019/0145219 | A1* | 5/2019 | Saraya | E21B 33/126 166/373 |
| 2019/0186240 | A1* | 6/2019 | Fitzhugh | E21B 23/01 |
| 2020/0232306 | A1* | 7/2020 | Brown-Kerr | E21B 47/01 |
| 2021/0293117 | A1* | 9/2021 | Bolivar | E21B 23/06 |

* cited by examiner

*Primary Examiner* — Nicole Coy
*Assistant Examiner* — Douglas S Wood

(57) ABSTRACT

Disconnecting an upper portion of a tool from a lower portion of a tool after a fracturing operation, wherein the upper portion has a same inner diameter as the lower portion. Specifically, the upper portion may be utilized during the fracturing job and be disconnected from the lower portion after the fracturing job.

23 Claims, 9 Drawing Sheets

INTERVENTIONLESS METHODS AND SYSTEMS FOR TESTING A LINER TOP

BACKGROUND INFORMATION

Field of the Disclosure

Examples of the present disclosure relate to methods and systems associated with disconnecting an upper portion of a tool from a lower portion of a tool after a fracturing operation, wherein the upper portion of the tool has a same minimum inner diameter as the minimum inner diameter of the lower portion of the tool, as well as the minimum inner diameter of the casing positioned below and above the tool. Specifically, the upper portion of the tool may be utilized during the fracturing job and be disconnected from the lower portion of the tool at a predetermined location after the fracturing job.

Background

Hydraulic fracturing is the process of creating cracks or fractures in underground geological formations. After creating the cracks or fractures, a mixture of water, sand, and other chemical additives, are pumped into the cracks or fractures to protect the integrity of the geological formation and enhance production of the natural resources. The cracks or fractures are maintained opened by the mixture, allowing the natural resources within the geological formation to flow into a wellbore, where it is collected at the surface.

Conventionally, in oil and gas operations, casing is run all way to the surface to allow for the hydraulic fracturing. Other methods for running casing include hanging or dropping the casing just above a horizontal or deviated section using a packer, a liner hanger, or a combination of both. Although this can be a cheaper method, it is still expensive and increases operational complexity.

Further, for refracturing jobs new casing must be run for a targeted zone, which must be isolated. This requires running a continuous casing within the wellbore, pumping cement inside the casing, allowing the cement to return up hole in an annulus between the new casing and the old casing. After cementing the casing in place, a neutral or free point along the casing, which is free of cement, is determined. The casing is then chemically cut above the cement before or after the fracturing procedure. The casing is severed before fracing if the pertinent casing it ran in is sufficient to handle new re-frac pressures. Otherwise, it will be left till after re-frac to severe. This requires multiple trips downhole to determine the free point after the casing is cemented and the cut the casing. Additionally, keeping the new casing all the way to surface without severing includes artificial lift challenges since the new casing that ran inside the old casing will have a smaller internal diameter. This limits the size of other artificial lift equipment needed to draw down oil from the well.

Accordingly, needs exist for systems and methods for a disconnect system with an upper portion of a tool having a continuous first inner diameter or never decreasing first inner diameter and a lower portion of the tool having the first inner diameter, wherein a location of disconnecting the upper portion from the lower portion is predetermined before running the upper portion, the lower portion, and casing above and below the tool downhole. To this end, the disconnect system will serve as conduit during the re-fracture that doesn't restrict an internal diameter of the casing above or below the disconnect system. This will allow standard tool sizes to pass through the casing and disconnect system, and protecting the parent casing from the re-fracturing pressure, while also providing a pre-determined point of severing the casing after the re-frac job is performed.

SUMMARY

Embodiments disclosed herein describe systems and methods for a disconnect tool that is configured to disconnect an upper portion of a device or tool from a lower portion of the device or tool at a predetermined location. The predetermined location is determined before running the tool and casing downhole together. Embodiments of the tool or device may include a lower portion and an upper portion (or running tool), wherein the tool or device is configured to form an integral part of casing positioned below the tool and/or casing positioned above the tool. In embodiments, the upper casing, lower casing, and/or the tool may have a minimum inner diameter, wherein a size of the minimum inner diameter does not decrease from the proximal end of the upper casing to a distal end of the lower casing.

The lower portion may be positioned downhole from the upper portion. The lower portion may include a bottom sub and a receptacle. The bottom sub may be configured to have a first inner diameter, wherein the first inner diameter may extend from a proximal end of the bottom sub to the distal end of the bottom sub. The bottom sub of the casing may be configured to be cemented in place before a fracturing job is performed. In embodiments, a packer may be positioned on an outer diameter of the bottom sub. The packer may be configured to isolate a first portion of an annulus from a second portion of the annulus, wherein the second portion of the annulus is positioned downhole from the first portion of the annulus. In embodiments, the packer may not be exposed to the fracturing pressure within the inner diameter of the bottom sub. The packer may be configured to be set after cementing and before fracturing, and restrict cement from leaking from the second portion of the annulus to the first portion of the annulus after fracturing or refracturing. This may ensure that the upper portion is not cemented in place, while the lower portion may be permanently positioned in place.

The receptacle may be a part of the lower portion that is configured to selectively couple the lower portion with the upper portion. The receptacle may be rotationally locked with bottom sub. In embodiments, an inner diameter across the receptacle may never be smaller than the first inner diameter. The receptacle may include a ledge, tie back profile, and threads.

The ledge may be configured to limit the downhole movement of the upper portion of the casing.

The tie back profile may be a depression, groove, indentation, etc. within the inner diameter of the receptacle. The tie back profile may be configured to receive a collet, dog, etc. positioned on an outer diameter of the upper portion, which may identify when then upper portion is positioned on the ledge. In other embodiments, the upper portion (or a new upper portion of the casing), may be reinserted into the well and coupled to the lower portion after being pulled out of hole.

The threads may be positioned on an inner diameter of the receptacle, and may be configured to interface with threads positioned on an outer diameter of the upper portion. Responsive to rotating the upper portion and the receptacle being rotationally fixed, the upper portion may disengage with the receptacle. This may allow the upper portion to be pulled out of the hole while the receptacle and bottom sub remain downhole. In other embodiments, the threads can be replaced by dogs or collets and a recess.

The upper portion may be a running tool or a portion of casing with a continuous or never decreasing inner diameter that extends from a proximal end of the casing to a distal end of the casing. The upper portion may be configured to mate with the lower portion. The continuous or never decreasing inner diameter may be the first inner diameter. After setting the upper portion downhole with the receptacle, the upper portion may cover an inner diameter of the lower portion receptacle. To this end, the upper portion and the bottom sub of the lower portion may form a same minimum and/or continuous inner diameter from a proximal end to a distal end of the tool, wherein the inner diameter across the tool never decreases to a size shorter than the continuous inner diameter.

Additionally, the running tool may be run in hole with receptacle, the lower portion and casing downhole, allowing a continuous or never decreasing inner diameter with a predetermined decoupling point. This may take a longer time to run the upper portion casing and lower portion downhole. Specifically, conventional systems utilize running tools with smaller inner diameters with casing with larger inner diameter. These conventional systems allow the running tools to run the casing downhole quicker using drill pipes, tubing. However, this requires additional cutting or disconnecting before fracing since the internal diameter of the drill pipe and the running tools will not allow equipment to pass through and set in the bigger internal diameter casing below.

The upper portion may be a running tool that is configured to be disconnected from a lower portion after a fracturing procedure. This may allow the running tool to be utilized during a fracturing or refracturing procedure, allowing all tools to pass through. After the fracturing operation, the running tool may be decoupled from the lower portion at the predetermined location, and pulled out of hole. Further, the outer diameter of the running tool may be configured to be positioned above the packer, and adjacent to the second portion of the annulus. This may allow cement volumes to be precisely calculated so the cement within the annulus won't cover the upper portion so the running tool will not be cemented in place. An outer diameter of the upper portion may include a radially expandable elements and/or threads.

The radially expandable elements may be a collet, dogs, etc. that are configured to radially expand based on an inner diameter its contained within.

The threads may be configured to interface with the threads on the inner diameter of the receptacle. Responsive to rotating the running tool, the threads on the upper portion may move uphole, and allow the threads on the running tool to disengage from the threads on the receptacle. The running tool may then be pulled out of hole after a fracturing or refracturing job.

In embodiments, the running tool may be a full-bore running tool that is deployed and remain in hole during the fracturing or refracturing job. Accordingly, an operator may utilize a same casing and same inner diameter from the running tool before or after the fracturing or refracturing operation, wherein the inner diameter across the running tool and the casing connector is never smaller than the drift diameter of the running tool. Specifically, current running tools cannot remain downhole during the fracturing or refracturing operation because they contain portions with a smaller inner diameter than that of the lower portion of the housing. This may limit the availability of sleeved tools, frac plugs, cement plugs, intervention tools, balls etc. inside a running tool that has a smaller inner diameter than that of the running tool. To this end, by maintaining an inner diameter across the running tool and the receptacle to be larger than the inner diameter of the casing, tools for the fracturing operation may be run through the running tool before disconnecting the upper portion from the lower portion.

More so, in embodiments, casings with the same minimum inner diameter as the running tool and the lower portion may be coupled above and below the running tool and the lower portion, respectively. This may allow the fracturing operation to be performed through the upper casing, the tool—including the running tool and lower portion, and the lower casing, which may all have the same minimum inner diameter and run in hole in a single run.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
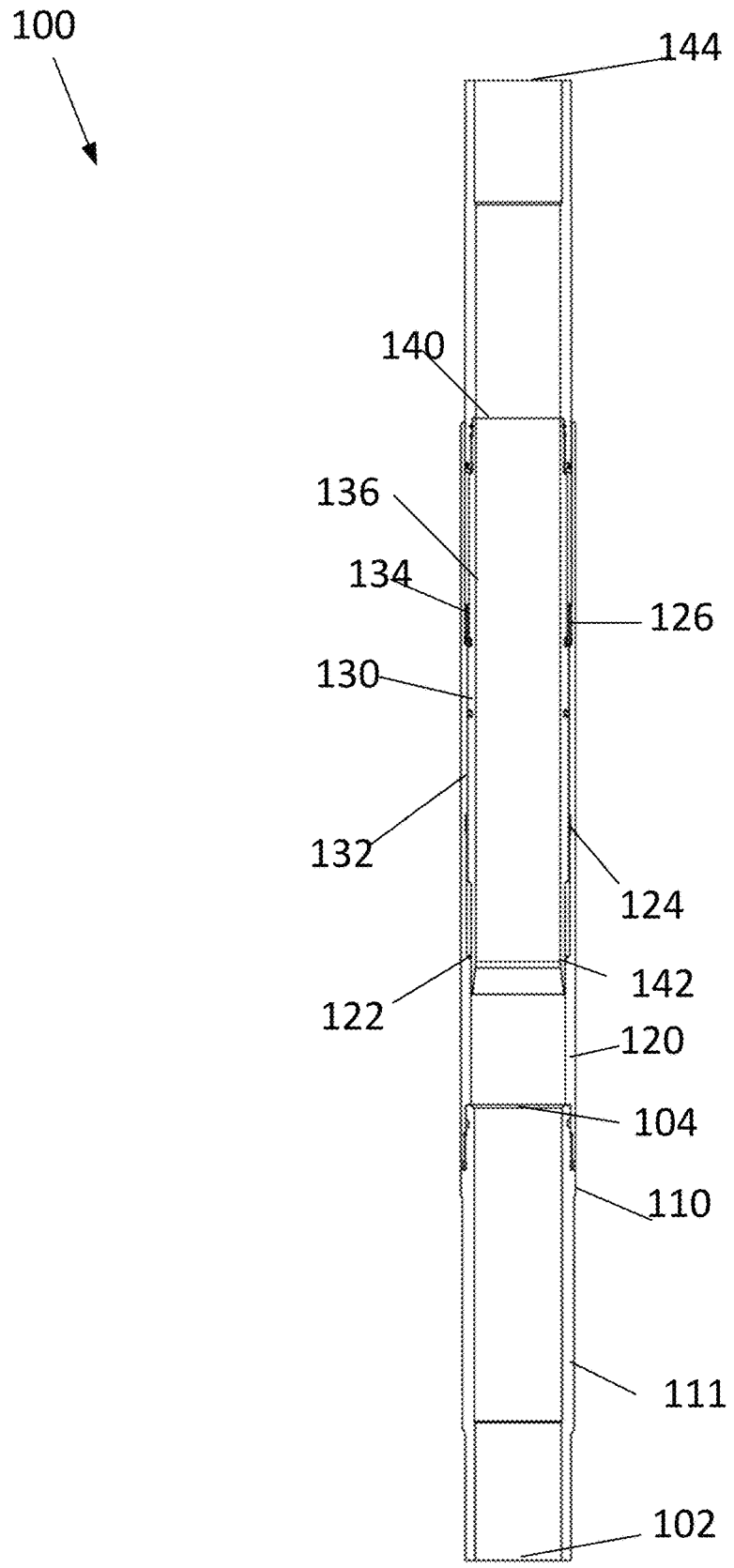
FIG. 1 depicts a system to fracture through a running tool, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Embodiments are directed towards systems and methods to utilize a running tool as an upper portion of casing to perform a fracturing operation through the running tool, wherein the fracturing operation may utilize at least 10,000 PSI. The running tool may be configured to not have a smaller inner diameter than a lower portion of the casing, which may allow for the running tool to be utilized during a fracturing or refracturing operation. Additionally, the running tool may be coupled with a receptacle at a predetermined location, wherein the decoupling location between the running tool and the lower portion is known before simultaneously running the running tool and the lower portion downhole.

FIG. 1 depicts a system 100 to fracture through a running tool 130, according to an embodiment. System 100 may include a lower portion 110 and running tool 130.

Lower portion 110 may be positioned downhole from the running tool 130. Lower portion 110 may include a bottom sub 111 and receptacle 120. Bottom sub 111 may be configured to have a first inner diameter, wherein the first inner diameter may extend from a proximal end 104 of bottom sub 111 to the distal end 102 of bottom sub 111. Lower portion 110 may be configured to be cemented in place before a fracturing job is performed. The distal end 102 of bottom sub 111 may be coupled with lower casing, tubing, pipe, etc. wherein an entirety of the lower casing may have the same first inner diameter. This may form a casing with a continuous first inner diameter.

Receptacle 120 may be a portion of system 100 that is configured to selectively couple lower portion 110 with running tool 130. Receptacle 120 may be rotationally locked with the lower portion 120. Receptacle 120 may include a ledge 122, tie back profile 124, and threads 126.

Figure 2:
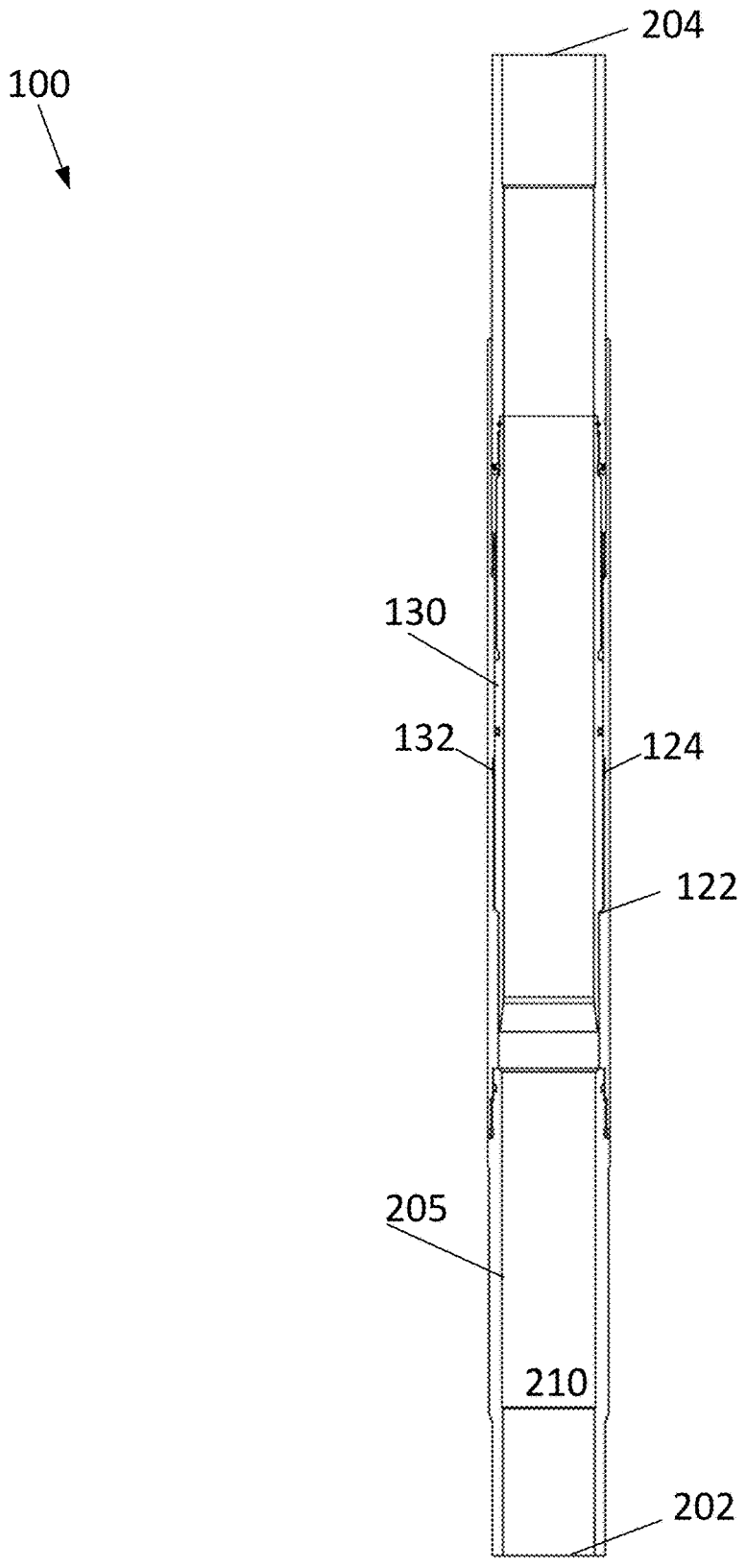
FIG. 2 depicts an embodiment of system for a running tool that can be utilized for a fracturing operation and running casing downhole.

Ledge 122 may be configured to limit the downhole movement of the running tool 130, where the running tool 130 will have the ability to stroke up and down across its axis until it lands on ledge 122. An inner diameter across ledge 122 may be greater than or equal to the first inner diameter. This may allow running tool 130 to slide radially inside of receptacle without decreasing a minimum inner diameter across system 100. When set down hole (as shown in FIG. 2), a distal end of running tool 130 may be positioned directly on ledge 122. This may cause system 100 to have a single, continuous inner diameter after being set, while also being able to be run in hole in a single run without any additional tools being positioned downhole to have the continuous same inner diameter. This single continuous inner diameter may allow permanent down tools, such as frac plugs, balls, to be run through system 100 before a fracturing operation, allow for the fracturing operation, and allow the running tool 130 to be disconnected from lower portion 110 without pulling tools out of system 100. Further, the continuous inner diameter of system 100 will reduce the pressure drop, allowing an increase in fluid flow rate during the frac operation compared to the restricted internal diameters of other running tools that are later positioned within system 100.

Tie back profile 124 may be a depression, groove, indentation, larger internal diameter section, etc. within the inner diameter of the receptacle 120. Tie back profile 124 may be configured to receive a collet, dog, etc. positioned on an outer diameter of the running tool 130, which may identify when then running tool 130 is positioned on the ledge 122. In other embodiments, a new upper portion of the casing (or a new running tool 130), may be reinserted into the well and coupled casing connector 130 after being pulled out of hole.

Threads 126 may be positioned on an inner diameter of the receptacle 120, and may be configured to interface with threads 134 positioned on an outer diameter of running tool 130. Responsive to rotating running tool 130, while receptacle 120 is rotationally fixed in place, running tool 130 may disengage with receptacle 120. This may allow running tool 130 to be pulled out of the hole.

Running tool 130 may be a running tool connected to a portion of casing positioned above running tool 130. The upper casing may be pipe, tubing, casing, etc. coupled to a proximal end of running tool 130 to form a continuous casing with the first inner diameter. Running tool 130 may have a continuous inner diameter that extends from a proximal end 130 to a distal end 142 of running tool 130, wherein the continuous inner diameter is the first inner diameter. In embodiments, the upper portion of the casing may have the same sized first inner diameter. Additionally, the running tool 130 may be run in hole, and move, the lower portion 110 downhole, and allow the continuous inner diameter of the same size with a predetermined decoupling point. Due to running tool 130, and upper casing above running tool 130, having a larger inner diameter when compared to conventional running tools with smaller internal diameters run on conventional drill pipe or tubing, running tool 130 may take longer to run lower portion 110, including the lower portions of the casing, downhole. Specifically, conventional systems utilize running tools with smaller inner diameters with casing with larger inner diameter, so the running tools can run the casing downhole quicker. However, this requires additional steps and procedures to later cut the casing.

Figure 7:
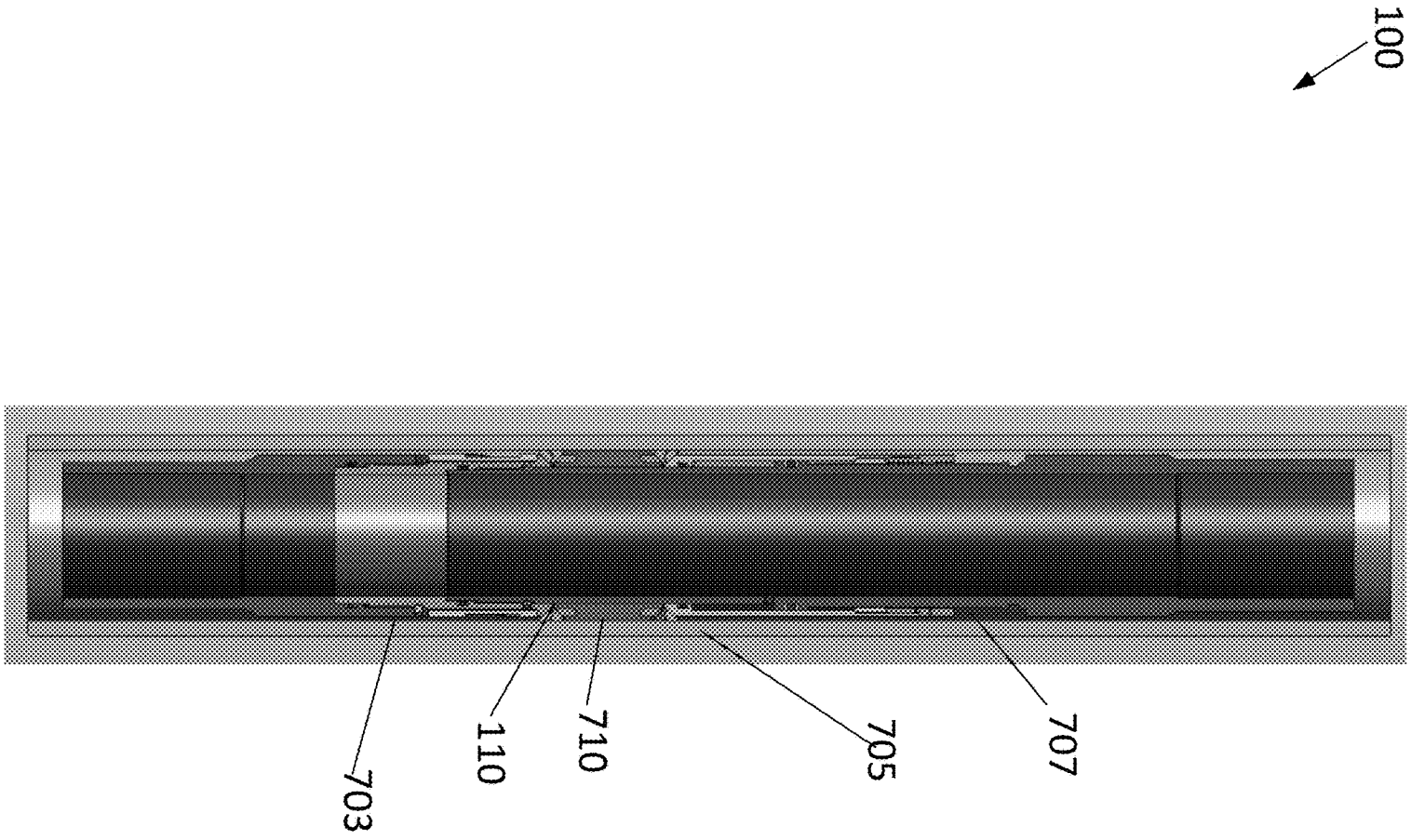
FIG. 7 depicts an embodiment of system for a running tool that can be utilized for a fracturing operation and running casing downhole.

Running tool 130 may be configured to be disconnected from a lower portion 110 of the casing after a fracturing procedure, enabling the casing above the running tool 130 to cover any weak point in the parent casing that won't be able to withstand the frac or re-frac pressure. This may allow running tool 130 to be utilized during a fracturing or refracturing procedure. The outer diameter of the running tool 130 may be configured to be positioned above a packer (as shown in FIG. 7), and adjacent to a second portion of the annulus. This may allow the running tool 130 to not be cemented in place, where cement will be volumetrically calculated to be circulated and only cement to a depth of the packer or above the depth of the packer. An outer diameter of running tool 130 may include a radially expandable elements 132 and threads 134.

Radially expandable elements 132 may be collets, dogs, etc. that are configured to radially expand based on an inner diameter across the receptacle 120. When radially expandable elements 132 are aligned with the tie back profile 124, which has a larger inner diameter, radially expandable elements 132 may radially expand to be positioned within the tie back profile 124. This may signify when running tool 130 is at a desired location downhole.

The threads 134 may be configured to interface with the threads 126 on the inner diameter of the receptacle 120. Responsive to rotating running tool 130 in a first direction, the threads 134 may move uphole, and allow the threads 134 to disengage from threads 126. This may allow running tool 130 to be pulled out of hole along with the upper portion of the casing after a fracturing or refracturing job, while lower portion 110 remains downhole.

In embodiments, running tool 130 may be a full-bore running tool that is deployed and remain in hole during the fracturing or refracturing job. Accordingly, an operator may utilize a same casing inner diameter from the lower portion 110 and the lower portions of the casing before or after the fracturing or refracturing operation, wherein the inner diameter across the running tool 130 and the receptacle is never smaller than the inner diameter of the lower portion 110. Specifically, current running tools cannot remain downhole during the fracturing or refracturing operation because they contain portions with a smaller inner diameter than that of the lower portion 110 and/or the casing positioned below lower portion. This may limit the availability of sleeved tools, frac plugs, cement plugs, etc. inside a running tool that has a smaller inner diameter than that of the lower portion of the casing. To this end, by maintaining an inner diameter across the running tool 130 to be larger than the inner diameter of lower portion 110, tools for the fracturing operation may be run through the running tool 130 and portions of casing above running tool 130 before disconnecting running tool 130 from the lower portion 110.

FIG. 2 depicts an embodiment of system 100. Elements depicted in FIG. 2 may be described above, and for the sake of brevity a further description of these elements may be omitted.

As depicted in FIG. 2, once running tool 130 is set, a projection on an outer diameter of running tool 130 may be positioned on ledge 122, and portions of running tool 130 may be positioned radially within receptacle 120. This may cause an entirety of an inner diameter from distal end 202 of system 100 to proximal end 204 of system 100 to be at least as large as the first diameter 210 across lower portion 110. Accordingly, when the running tool 130 is set, portions or an entirety of an inner diameter of the receptacle 120 may not be exposed to the passageway from proximal end 204 to distal end 202. In embodiments, portions of receptacle 120 that have an inner diameter that is larger than the first diameter 210 may be exposed and not covered by bottom end 220 of running tool 130.

Figure 3:
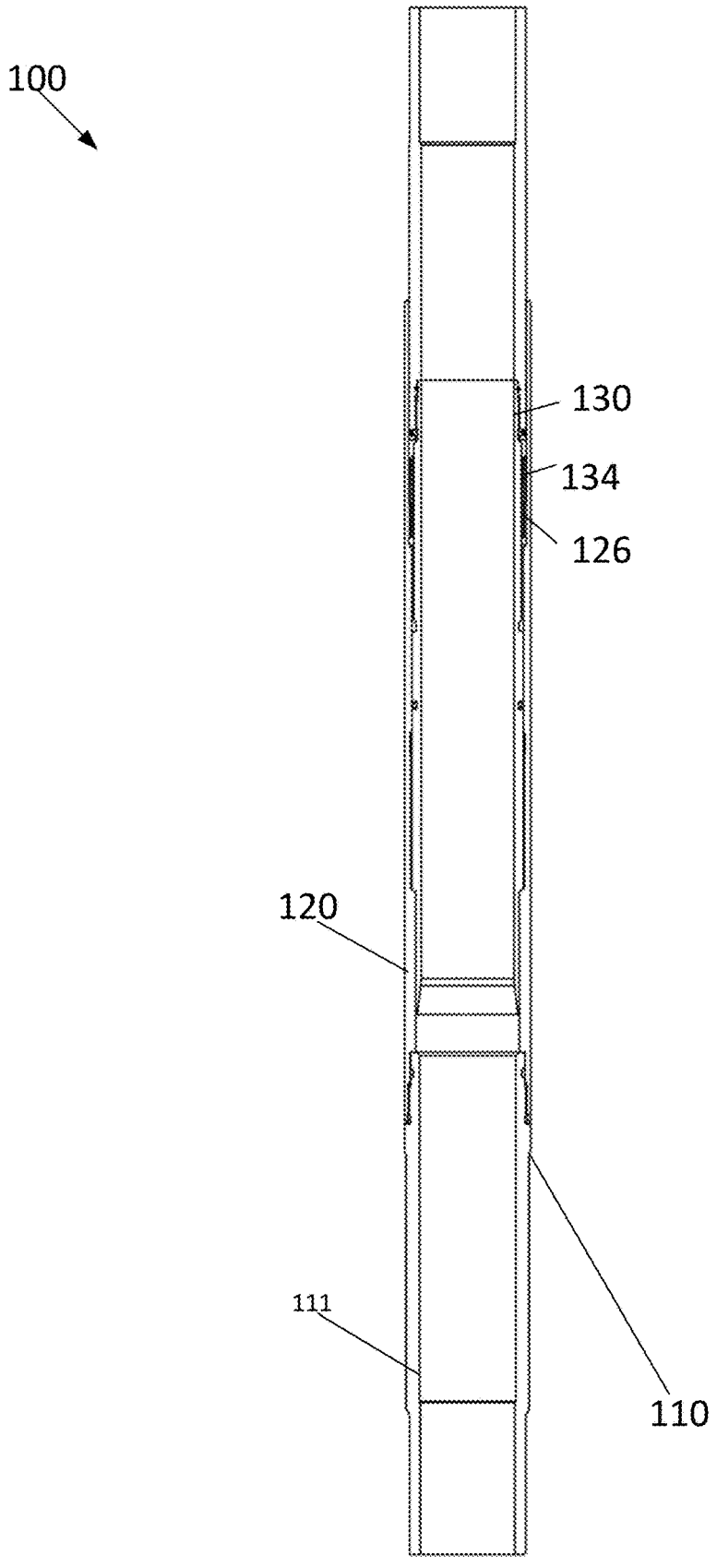
FIG. 3 depicts an embodiment of system for a running tool that can be utilized for a fracturing operation and running casing downhole.

FIG. 3 depicts an embodiment of system 100. Elements depicted in FIG. 3 may be described above, and for the sake of brevity a further description of these elements may be omitted.

As depicted in FIG. 3, after a fracturing or refracturing operation, running tool 130 may be rotated relative to receptacle 120, threads 134 may be disengaged and positioned uphole from threads 126. This may allow running tool 130 to be disconnected from lower portion 110 at a predetermined location.

Figure 4:
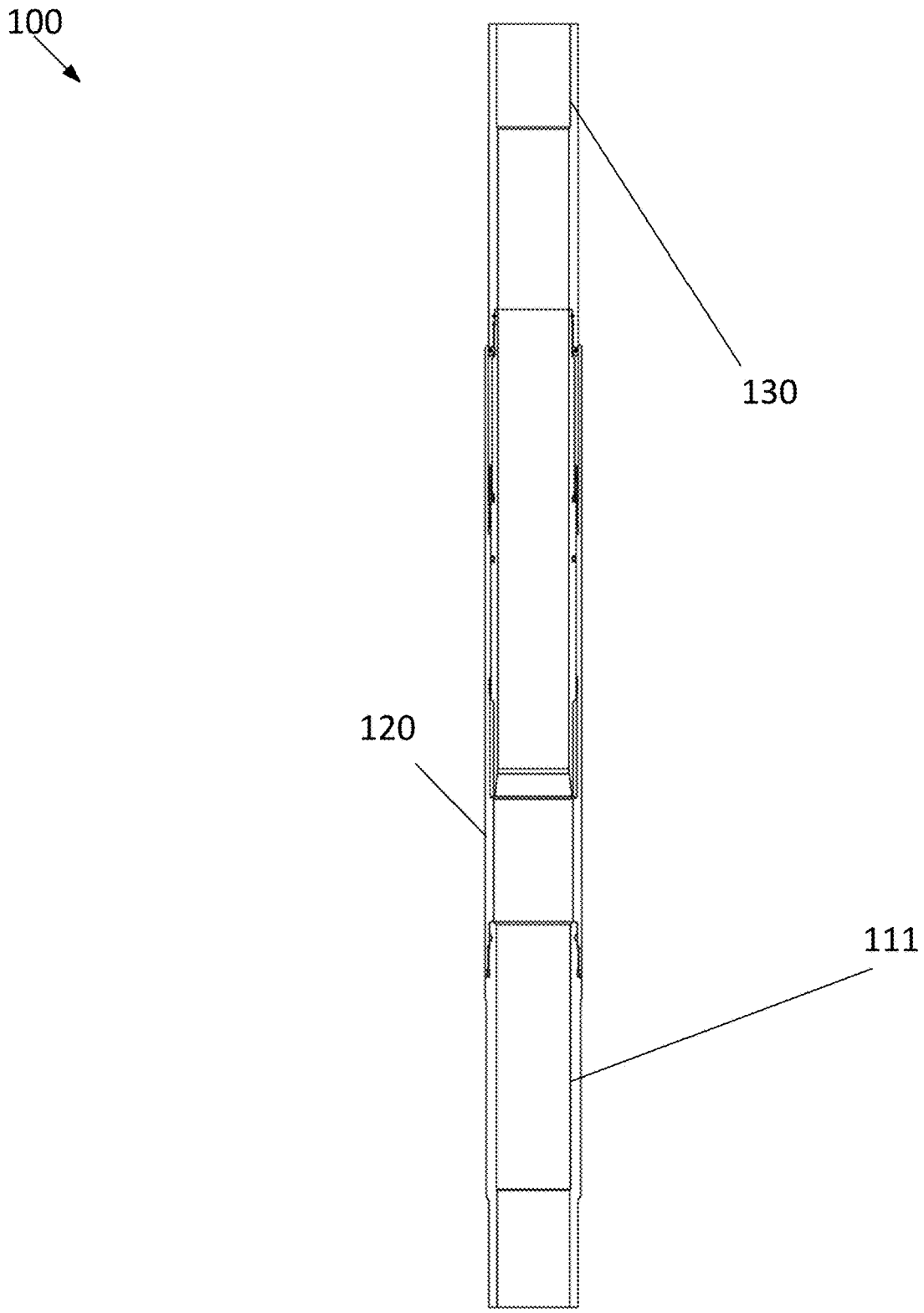
FIGS. 4 and 5 depict an embodiment of system for a running tool that can be utilized for a fracturing operation and running casing downhole.
Figure 5:
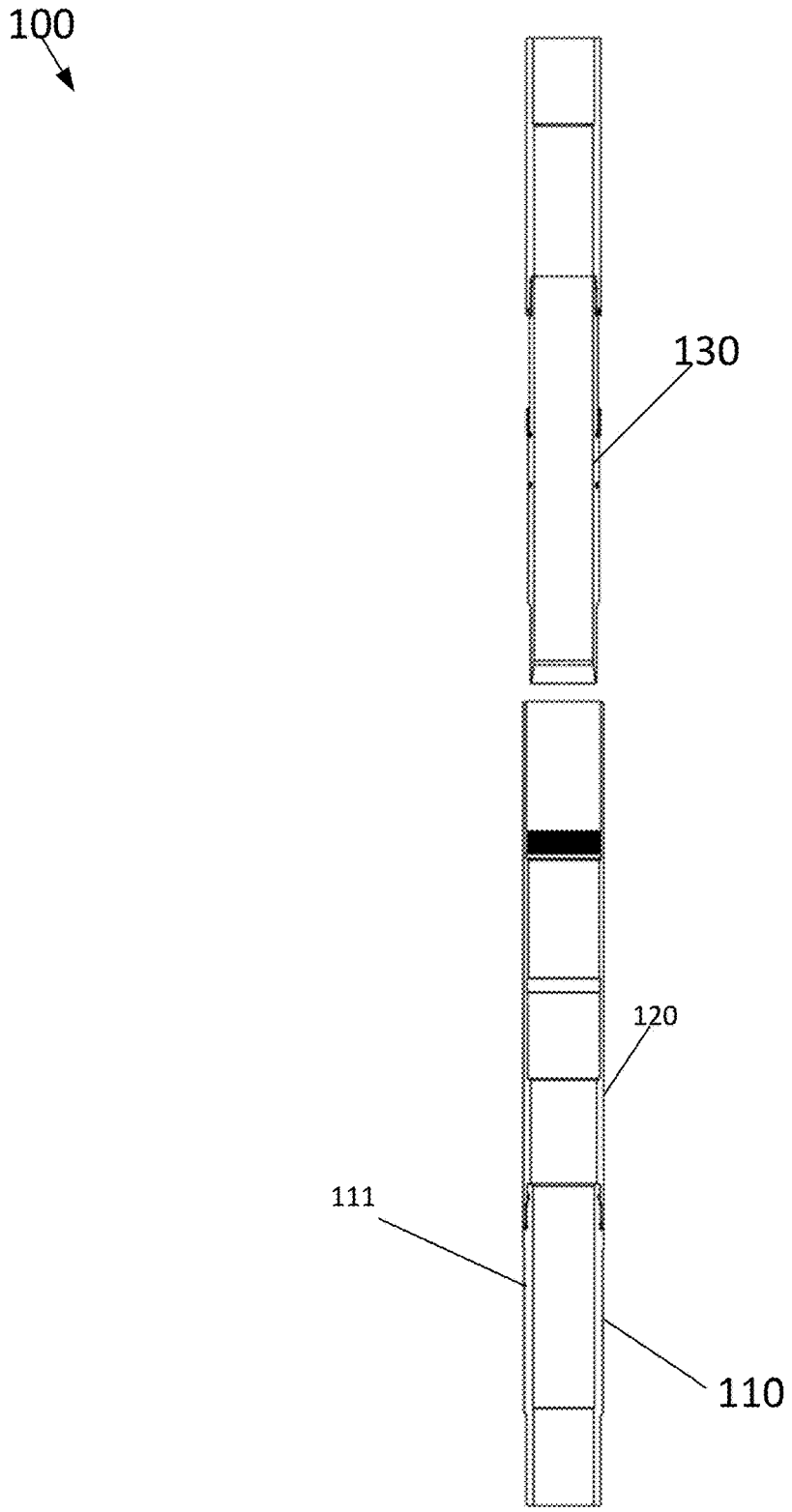

FIGS. 4 and 5 depict an embodiment of system 100. Elements depicted in FIGS. 4 and 5 may be described above, and for the sake of brevity a further description of these elements may be omitted.

As depicted in FIGS. 4 and 5, running tool 130 may be pulled out of the hole, while receptacle 120 and lower portion 110 of casing remains downhole.

Figure 6:
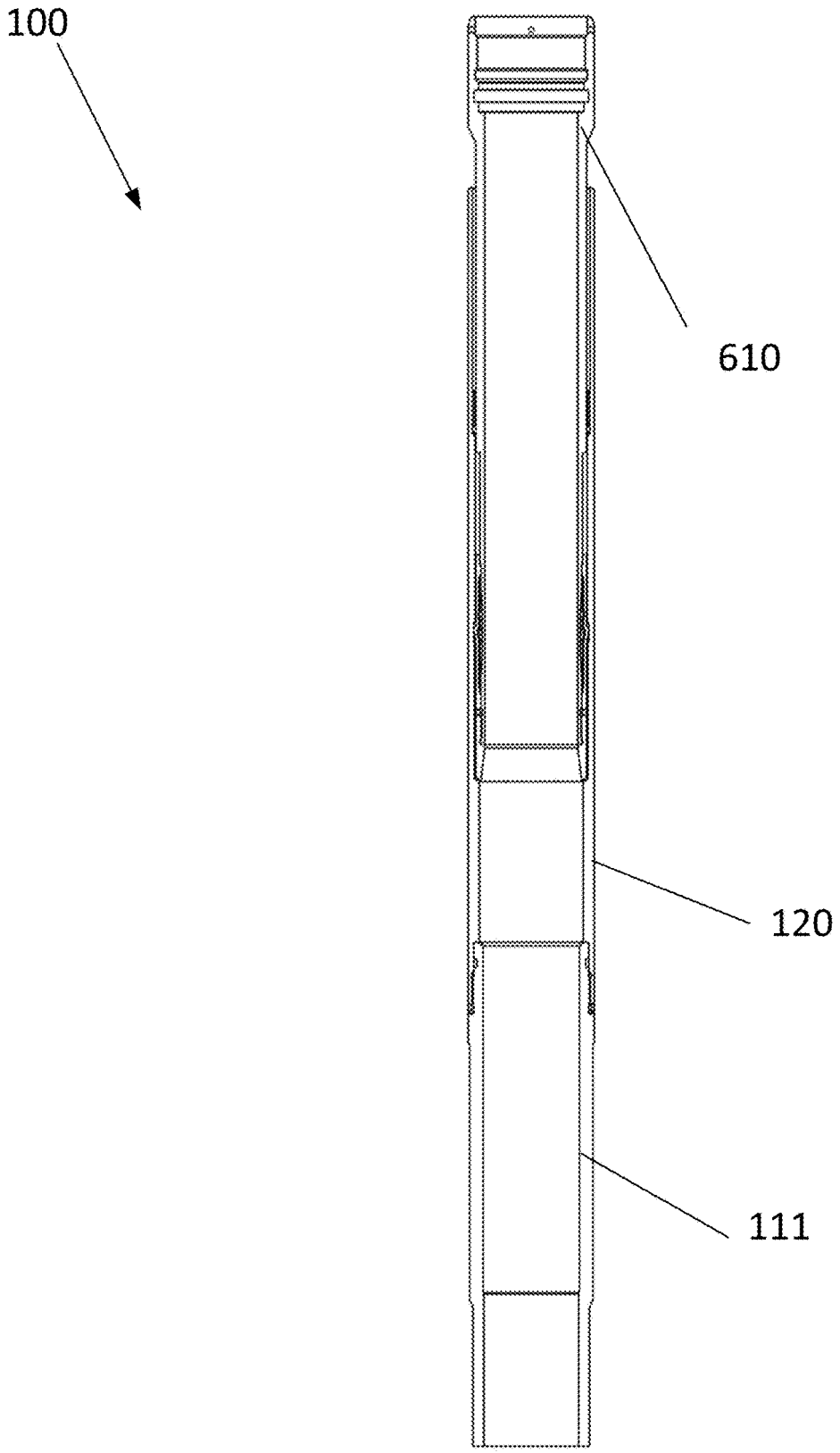
FIG. 6 depicts an embodiment of system for a running tool that can be utilized for a fracturing operation and running casing downhole.

FIG. 6 depicts an embodiment of system 100. Elements depicted in FIG. 6 may be described above, and for the sake of brevity a further description of these elements may be omitted.

In embodiments, after a running tool 130 has been pulled out of the hole, a new section of casing 610 that would seal inside lower portion 110 may be reinserted onto receptacle 120.

FIG. 7 depicts an embodiment of system 100. Elements depicted in FIG. 7 may be described above, and for the sake of brevity a further description of these elements may be omitted.

As depicted in FIG. 7, lower portion 110 of casing may include a packer 710. Packer 710 may be configured to radially expand across an annulus to isolate a first area 703 below packer 710 from a second area 707 above packer 710. In embodiments, when expanded packer 710 may expand across the annulus from an outer diameter of bottom sub 111 to an inner diameter of existing casing 705.

Figure 8:
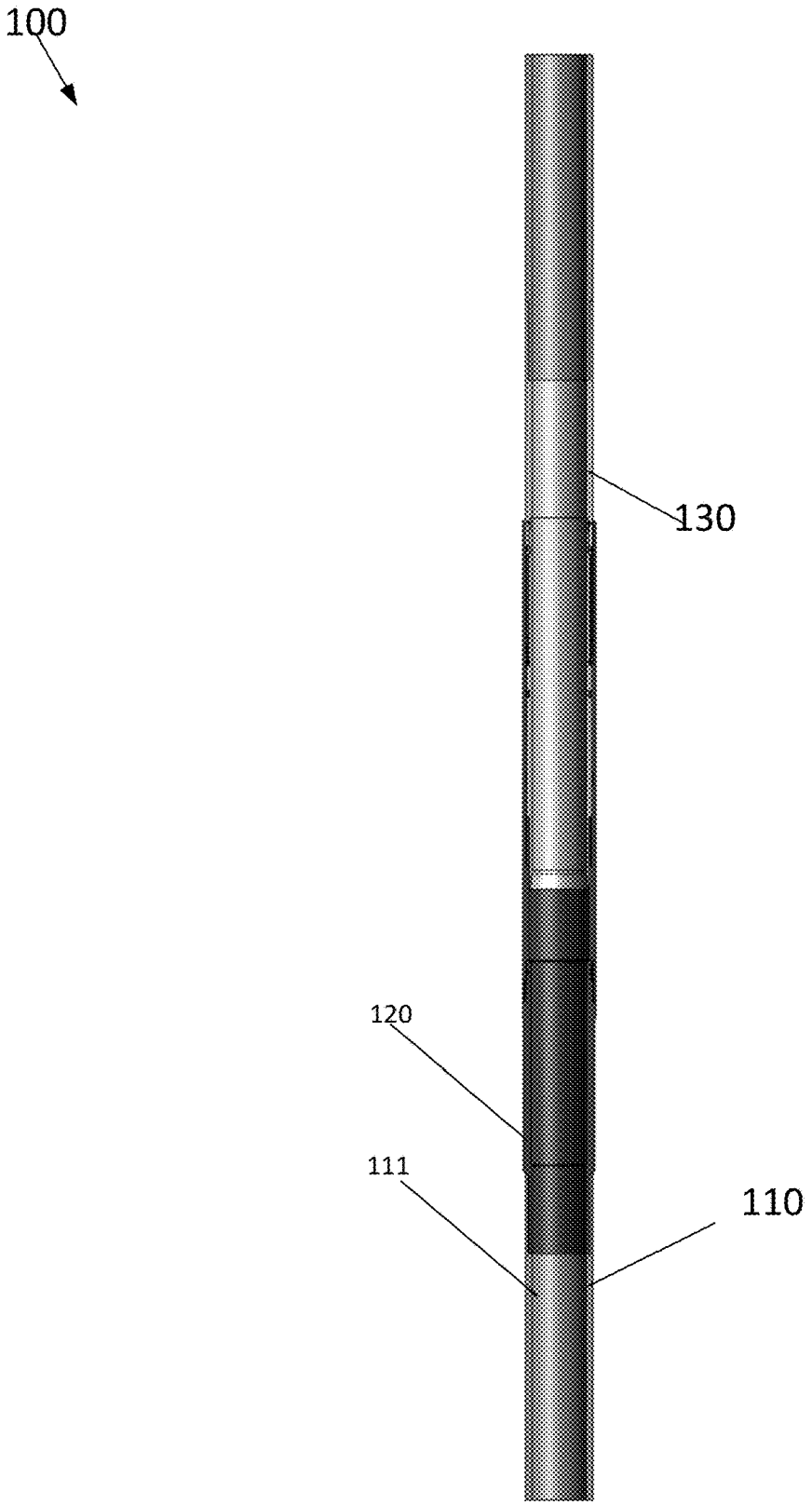
FIG. 8 depicts an embodiment of system for a running tool that can be utilized for a fracturing operation and running casing downhole.

FIG. 8 depicts an embodiment of system 100. Elements depicted in FIG. 8 may be described above, and for the sake of brevity a further description of these elements may be omitted.

As depicted in FIG. 8, running tool 130 may extend towards a surface, at a significant distance, without minimizing an inner diameter across the system 100.

Figure 9:
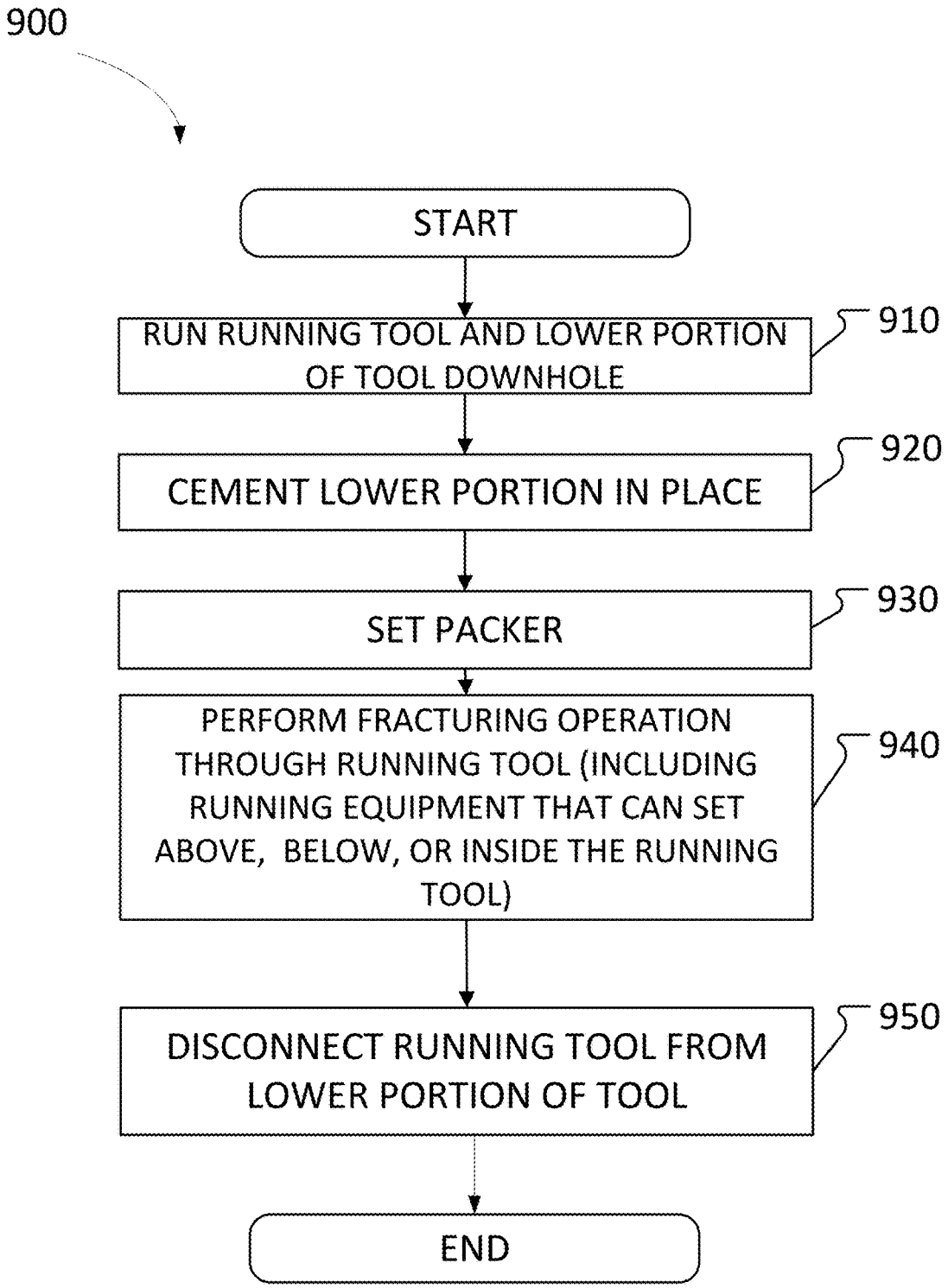
FIG. 9 illustrates a method for a running tool that can be utilized for a fracturing operation and running casing downhole, according to an embodiment.

FIG. 9 illustrates a method 900 for a running tool that can be utilized for a fracturing operation and running casing downhole, according to an embodiment. The operations of method 900 presented below are intended to be illustrative. In some embodiments, method 900 may be accomplished with one or more additional operations not described, and/or without one or more of the operations discussed. Additionally, the order in which the operations of method 900 are illustrated in FIG. 9 and described below is not intended to be limiting.

At operation 910, a running tool with a continuous first minimum inner diameter may be run in hole along with a lower portion of the system, wherein the lower portion of the system has the continuous first minimum inner diameter as well. To this end, the running tool and the lower portion of the system may have a full bore wherein the inner diameter of the casing is never reduced to a length shorter than the first minimum inner diameter.

At operation 920, the lower portion of the system may be cemented in place, while the running tool is not cemented in place, which allows for axial movement of the running tool but not the lower portion. In embodiments, the lower portion of the system may include a receptacle configured to couple the running tool and a bottom sub.

At operation 930, a packer positioned on an outer diameter of the lower portion of the system may extend across an annulus.

At operation 940, permanent downhole tools may be run in hole through the running tool and the lower portion of the system. When the tools are run through the system, the tools, such as a frac plug for zonal isolation, may be set above, below, or within the running tool. Then, a fracturing operation may be performed through the running tool, with the tools set, and the lower portion of the system.

At operation 950, the running tool may be disconnected from the lower portion of the system at a predetermined location, wherein the predetermined location is known before operation 910. To this end, additional tools or additional runs are not needed to disconnect the running tool from the lower portion of the casing. Further, the running tool may be pulled out of the hole while the lower portion of the system remains cemented in place.

As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A method for a disconnect system comprising:

positioning a device with a running tool and a lower portion as integral part of casing, wherein the device has a minimum inner diameter that does not decrease in size from an inner diameter of the casing, and an inner diameter of the casing being the minimum inner diameter from a proximal end of the casing to a distal end of the casing, cementing the lower portion in place while not cementing the running tool in place;

performing a fracturing operation through the minimum inner diameter that does not decrease in size from the inner diameter of the casing;

disconnecting the running tool from the lower portion via rotation after the fracturing operation or a refrac operation.

2. The method of claim 1, further comprising:

the casing being positioned below the lower portion, and the casing not being cemented when the lower portion is cemented;

disconnecting the running tool from the lower portion at a predetermined location, wherein the predetermined location is known before running the tool downhole.

3. The method of claim 1, further comprising:

volumetrically calculating an amount of cement to be pumped so that after displacement the cement can't reach the running tool to cement the running tool in place.

4. The method of claim 1, further comprising:

radially expanding a packer across an annulus before performing the fracturing operation, the packer being positioned on an outer diameter of the lower portion.

5. The method of claim 1, wherein the packer is positioned axially below the lower portion.

6. The method of claim 1, further comprising:

sealing the running tool inside the lower portion, where the running tool is free to axially move during the fracturing operation.

7. The method of claim 6, wherein when the running tool seals inside the lower portion, the running tool having the same minimum inner diameter that does not decrease in size from an inner diameter of the casing.

8. The method of claim 7, wherein the casing and the running tool have the minimum inner diameter that does not decrease in size from the inner diameter of the casing without positioning additional tools downhole.

9. The method of claim 2, wherein the lower portion includes a bottom sub and a receptacle, the receptacle coupling the bottom sub and the running tool, wherein portions of an inner diameter of the receptacle are not exposed to an internal passageway extending from a proximal end to a distal end of the running tool during the cementing, fracturing operation, and the disconnecting.

10. The method of claim 9, further comprising:

positioning a radially expandable element as integral part of the tool.

11. The method of claim 9, wherein a radially expandable element is not positioned as integral part of the tool.

12. The method of claim 11, where the radially expandable element is a packer used to seal between an outer diameter of the tool and an internal diameter of parent casing, wherein the seal provides a predetermined point so cement doesn't cover the outer diameter of the running tool.

13. The method of claim 1, further comprising:

pulling the running tool out of the hole after the disconnecting.

14. The method of claim 1, further comprising:

positioning the running tool and lower portion within parent casing downhole, wherein the parent casing has a larger inner diameter than an outer diameter of the running tool and an outer diameter of the lower portion.

15. The method of claim 14, wherein the running tool includes upper portions of casing having the minimum inner diameter.

16. The method of claim 15, further comprising:

covering weak points of the parent casing above the running tool with the upper portions of casing.

17. The method of claim 16, further comprising:

performing the fracturing operation through the upper portions of casing covering the weak points of the parent casing, wherein the weak points of the parent casing would not be able to withstand pressures associated with the fracturing operation.

18. The method of claim 1, further comprising:

coupling upper portions of casing to a proximal end of the running tool, wherein the upper portions of the casing have the never decreasing minimum inner diameter, and the upper portions of the casing are not cemented in place.

19. The method of claim 1, further including:

running the device downhole on pipe, the pipe having the minimum inner diameter from a proximal end of the pipe to a distal end of the pipe.

20. A method for a disconnect system comprising:

positioning a device with a running tool and a lower portion as integral part of casing, wherein the device has a minimum inner diameter that does not decrease in size from an inner diameter of the casing, and an inner diameter of the casing being the minimum inner diameter from a proximal end of the casing to a distal end of the casing, cementing the lower portion in place while not cementing the running tool in place;

performing a fracturing operation through the minimum inner diameter that does not decrease in size from the inner diameter of the casing, wherein the casing is upper casing, wherein the running tool is configured to be a conduit during the fracturing operation or re-fracture operations that doesn't restrict an internal diameter of the upper casing positioned above the device or the casing positioned below the lower portion;

allowing standard sized tools to pass through the upper casing, the casing positioned below the lower portion, and the device.

21. A method for a disconnect system comprising:

positioning a device with a running tool and a lower portion as integral part of casing, wherein the device has a minimum inner diameter that does not decrease in size from an inner diameter of the casing, and an inner diameter of the casing being the minimum inner diameter from a proximal end of the casing to a distal end of the casing, cementing the lower portion in place while not cementing the running tool in place;

performing a fracturing operation through the minimum inner diameter that does not decrease in size from the inner diameter of the casing; and performing a tie back operation between a secondary running tool and the lower portion after the first running tool is decoupled and retrieved out of the hole.

22. The method of claim 21, wherein the lower portion includes a receptacle and a bottom sub, wherein the tie back operation is performed by inserting radially expanding elements on an outer diameter of the secondary running tool into the receptacle.

23. The method of claim 22, further comprising:

applying upward force on the secondary running tool to radially retract the radially expanding elements and pull the secondary running tool out of hole.

* * * * *